US005133550A

United States Patent [19]

Handy

[11] Patent Number: 5,133,550

[45] Date of Patent: Jul. 28, 1992

[54] FOOTBALL HAVING RAISED RIBS

[75] Inventor: John N. Handy, Long Beach, Calif.

[73] Assignee: Mattel, Inc., El Segundo, Calif.

[21] Appl. No.: 735,406

[22] Filed: Jul. 24, 1991

[51] Int. Cl.[5] ..... A63B 43/02

[52] U.S. Cl. ..... 273/65 EE; 273/65 EG; 273/58 K

[58] Field of Search ..... 273/65 EG, 65 EE, 58 K, 273/65 EC, 65 ED, 65 EF; 40/327; D21/204, 205, 209

[56] References Cited

U.S. PATENT DOCUMENTS 4,919,422 4/1990 Ma ..... 273/65 EG

*Primary Examiner*—George J. Marlo
*Attorney, Agent, or Firm*—Roy A. Ekstrand

[57] ABSTRACT

A football-shaped game ball is formed of a resilient foam material and defines an oblate spheroidal outer surface having generally pointed ends. A plurality of rib portions extend outwardly from the outer surface and define nonsymmetrical cross-sections. In the preferred embodiment shown, the rib portions define generally saw-tooth shaped cross-sections which may be gripped in either of two gripping manners and which provide differing alternative aerodynamic characteristics depending upon the direction of spin imposed upon the football.

12 Claims, 2 Drawing Sheets

FOOTBALL HAVING RAISED RIBS

FIELD OF THE INVENTION

This invention relates generally to game balls and particularly to those shaped similar to an American football.

BACKGROUND OF THE INVENTION

Within the United States of America and many other areas of the world, one of the most popular game balls is that known as an American football. The ball used in the American version of football is similar to the earlier ball used in the European game of Rugby but has evolved to a smaller size having generally more pointed end portions. Through tradition and a number of competitive league rules, footballs are generally fabricated in accordance with rigidly and precisely defined physical construction. While some variety of footballs exist in different footballs leagues, most include a spheroidal outer skin formed of leather or plastic within which an inflatable rubber bladder is supported. The bladder is inserted into the outer skin through an elongated slot which is thereafter closed with a plurality of laces similar to a shoelace. In later developments, footballs have been formed having a continuous outer rubber skin manufactured through the use of molding processes. When so made, however, most such footballs retain the outer characteristic and appearance of a more conventional traditional football including the presence of simulated raised laces. The laces on the football have become important in that they provide a portion of the gripping mechanism used by a football passer in throwing a football.

In attempts to find more interesting and exciting types of footballs for use by players of all ages, practitioners in the art have produced a variety of football designs which are "nonstandard" and which depart from the above-mentioned traditional shapes and thus are used more for amusement and entertainment outside of organized traditional football competition. Among the objectives in providing such a variety of football shapes has been the need for different flight characteristics, different gripping patterns, as well as the general ever present desire for variety among consumers. In attempting to meet and satisfy this need for variety, practitioners have provided a virtually endless array of football shapes and configurations.

For example, U.S. Pat. No. 4,887,814 and U.S. Pat. No. Des. 294,844 both issued to Winter set forth a GAME BALL for sport and recreational activities having a football-shaped body formed of a resilient elastically deformable material having channels associated therewith. The channels are generally helically wound about the ball from one end to the other and are intended to receive the user's individual fingers within the channel when the ball is gripped.

U.S. Pat. Re. 33,449 issued to Martin sets forth a HELICALLY GROOVED FOAM FOOTBALL in which an elastic foam football defines an outer surface within which lengthwise spiral grooves having increasing width and depth toward the middle portion of the ball are formed for improved handling. The helical pattern of the grooves is selected to permit the user to insert the user's finger end portions into a single groove when the football is gripped.

U.S. Pat. No. 2,194,674 issued to Riddel sets forth a FOOTBALL in which a conventional shaped football is formed of a plurality of rigid outer segments joined at a plurality of helical seams, each joint seam forming upwardly extending ridges upon the football surface. An inflatable bladder is received within the football and inflated to pressurize the ball.

U.S. Pat. No. Des. 235,794 issued to Kroener sets forth a FOOTBALL WITH SPIRAL SEAMS in which a conventionally shaped football defines a plurality of spiral seams extending from one end of the ball to the other. The seams form inwardly extending grooves.

U.S. Pat. No. 2,859,040 issued to Gow, et al. sets forth a FOOTBALL HAVING A SECURELY GRIPABLE LACELESS SURFACE in which a football defines a pressurized interior cavity having a pneumatic bladder therein and an outer surface characterized by a plurality of gripping ridges. The center one-third of the football defines a plurality of straight ridges extending along the football's major axis while the remaining end portions of the football surface define concentric circular ridges extending transversely to the football major axis.

U.S. Pat. No. 4,736,948 issued to Thomas sets forth a FOOTBALL having an oblate spheroid body defining a passageway along its longitudinal axis. A pair of wind fins are mounted internally of the body so as to protrude into the passageway. An alternate embodiment is set forth in which a plurality of inwardly extending grooves are defined in the outer surface of the football.

U.S. Pat. No. 3,884,466 issued to MacDonald, et al. sets forth a GAME BALL having a football shape which defines an air passage extending through its longitudinal axis. The diameter of the air passage tapers from opposite ends of the football to a constricted opening in the center thereof. A plurality of relatively heavy weights are supported by the football encircling the constricted passage.

U.S. Pat. No. 1,931,429 issued to Buckner, et al. sets forth a FOOTBALL having a conventional inflated football further defining a plurality of helical grooves in the outer surface thereof. An abrasive material is deposited within the helical grooves to enhance the gripping characteristics of the football.

U.S. Pat. No. 4,919,422 issued to Ma sets forth a CURVE BALL having a generally spherical shape and balance and defining an axis therethrough. First and second convex surfaces are defined about the axis at opposite poles thereof and at least one groove having a non-uniform depth defined in the surface of the ball between the first and second convex surfaces. The groove is arranged to extend through the equatorial region of the ball between the first and second convex surface. The spherical-shaped ball is thrown so as to impart spin thereto at different angles to the axis to create various curving actions.

While the foregoing described prior art devices have provided increased variety and different aerodynamic characteristics for football shaped game balls, there remains a continuing need in the art for evermore interesting and varied game balls to meet consumer appetites for improvement and variety.

SUMMARY OF THE INVENTION

Accordingly, it is a general object of the present invention to provide an improved football shaped game ball. It is a more particular object of the present invention to provide an improved football shaped game ball which provides a selection of gripping patterns and aerodynamic characteristics for the user.

In accordance with the present invention, there is provided a football comprises: a body having a football shape and defining an outer surface and generally pointed ends and a major axis; and a plurality of spaced-apart rib members extending outwardly from the outer surface forming spiral curves about the major axis, the rib members define nonsymmetrical cross sections to produce different aerodynamic effects in each spin direction about the major axis.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
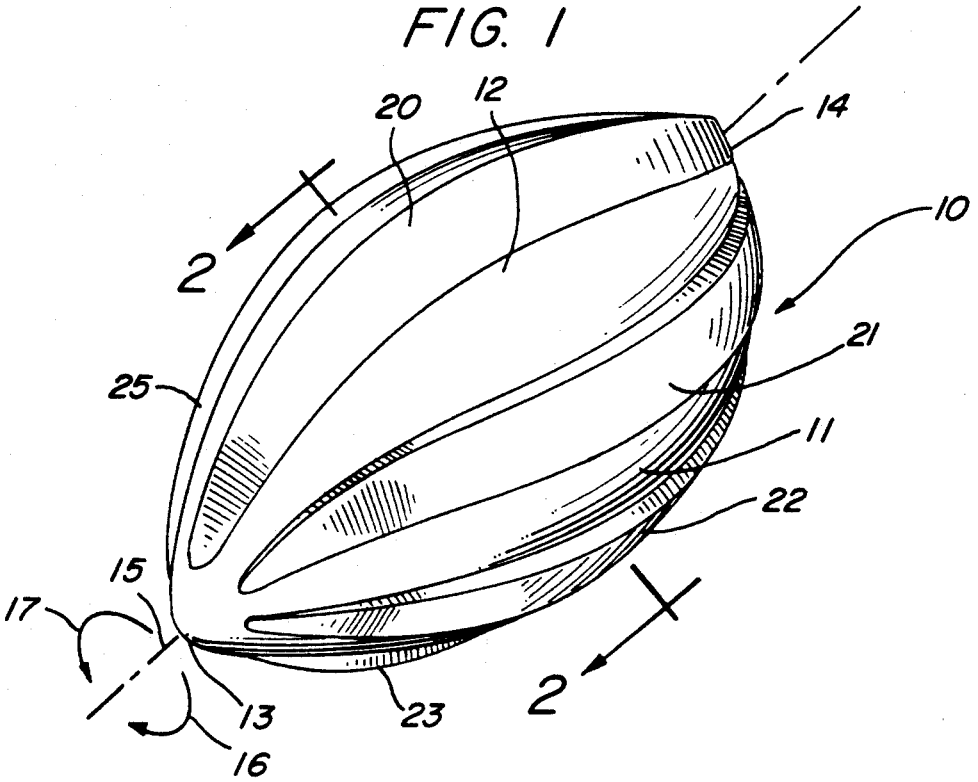
FIG. 1 sets forth a perspective of a football constructed in accordance with the present invention.

FIG. 1 sets forth a perspective view of a football constructed in accordance with the present invention and generally referenced by numeral 10. Football 10 defines a oblate spheroidal body 11 preferably formed of a resilient form material such as plastic, rubber or the like. Body 11 defines generally pointed end portions 13 and 14 aligned along a major axis 15. Body 11 further defines a curved smooth outer surface 12. In accordance with an important aspect of the present invention, football 10 further includes a plurality of outwardly extending rib members 20 through 25 (seen in FIG. 2). In the preferred construction of football 10, ribs 20 through 25 are arranged upon outer surface 12 in generally similar helical patterns in an equally spaced arrangement which is symmetrical about major axis 15.

In further accordance with an important aspect of the present invention, ribs 20 through 25 define nonsymmetrical aerodynamic shapes, the importance of which is set forth below in greater detail. Specifically, rib 20 defines a generally curved surface 30 extending outwardly from outer surface 12. Curved surface 30 forms an edge 60 at outer surface 12 on one side and extends in an increasing extension from outer surface 12 to form a raised curved face terminating at an edge 50. As is better seen in FIG. 2, curved surface 30 departs from outer surface 12 in an angle relationship thereto. An inclined face 40 extends between edge 50 and outer surface 12 forming a more sharply angled face upon rib 20.

Figure 2:
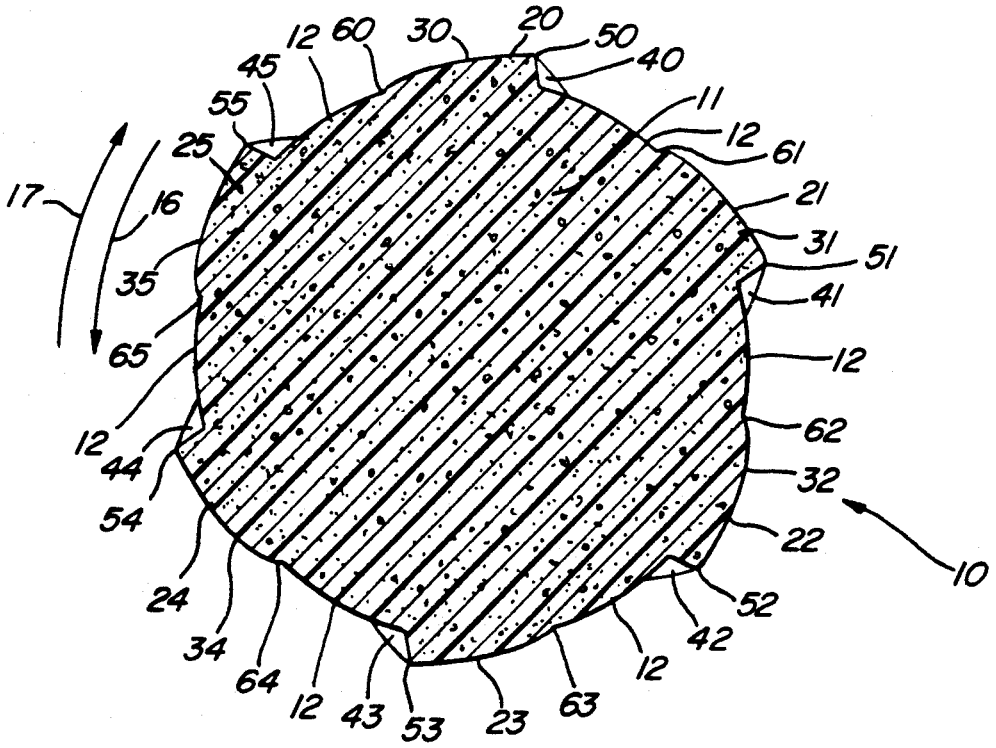
FIG. 2 sets forth a section view of the present invention football taken along section lines 2—2 in FIG. 1.

As is better seen in FIG. 2, ribs 21 through 25 define identical shapes and configurations to that described for rib 20. Thus, as is seen in FIG. 1, for example, rib 21 defines a curved surface 31 extending between edges 61 and 51 and defining an inclined sharply angled face 41. By way of further example, rib 22 defines a curved surface 32, an edge 62, an edge 52, and a sharply angled facet 42.

As is described below in greater detail, the nonsymmetrical character of ribs 20 through 25 upon outer surface 12 produce alternative aerodynamic characteristics for football 10 in each of the spin directions about major axis 15. Thus, when football 10 is gripped and thrown by the user so as to spin about major axis 15 in the direction indicated by arrow 16, ribs 20 through 25 produce an aerodynamic characteristic defined by the aerodynamic elements presented by ribs 20 through 25 during flight. In contrast, when football 10 is gripped in the opposite manner and thrown so as to spin about major axis 15 in the opposite direction indicated by arrow 17, the aerodynamic characteristic presented by ribs 20 through 25 is distinctly different from that provided when football 10 is spun about major axis 15 in the direction of arrow 16.

Figure 4:
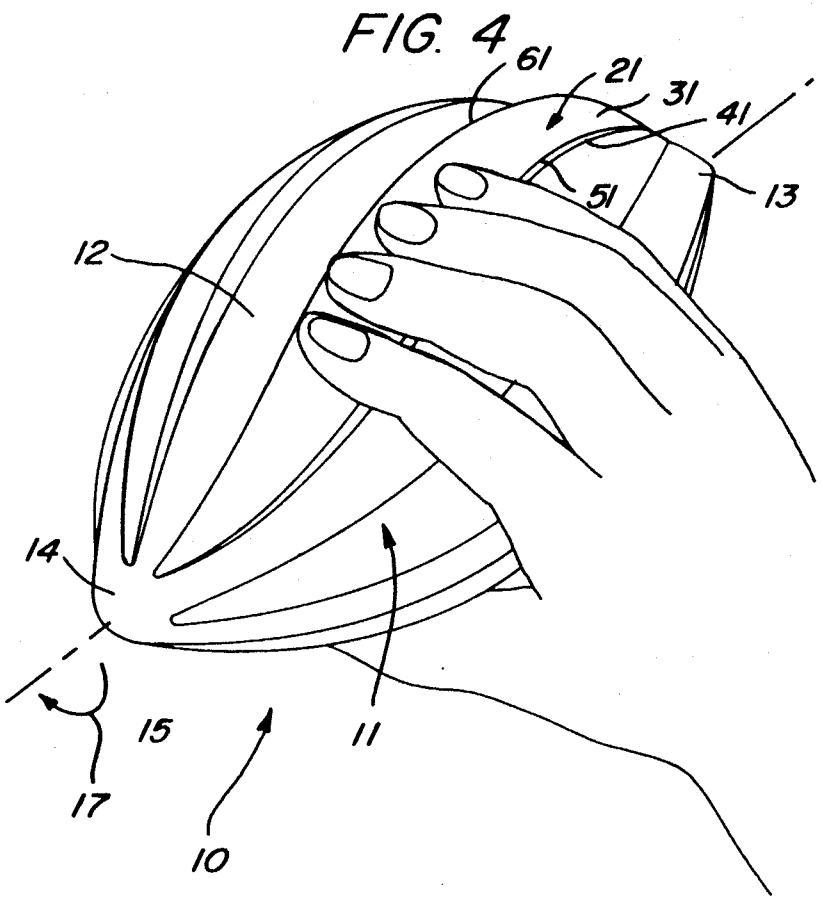
FIG. 4 sets forth a perspective view of an alternative gripping action by a user.
Figure 3:
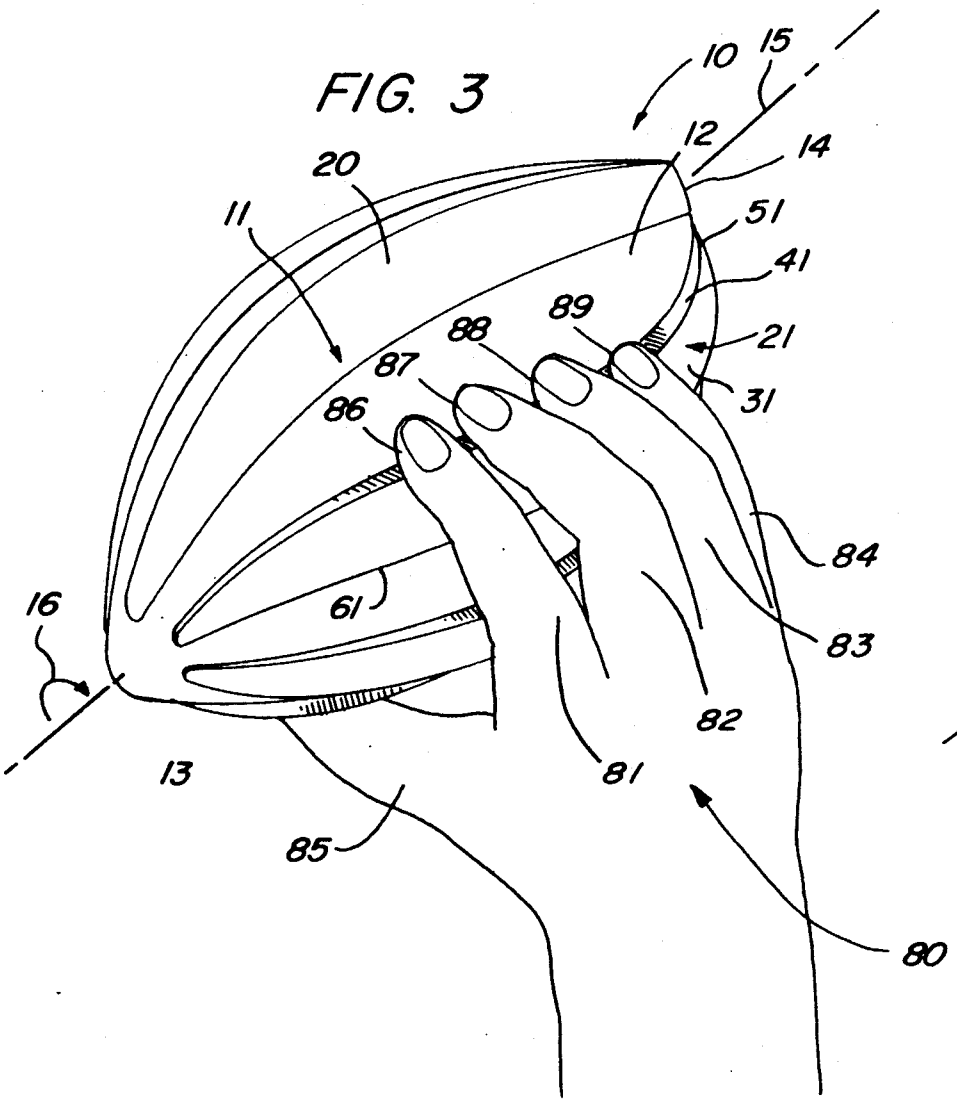
FIG. 3 sets forth a perspective view of the present invention football showing a typical gripping action by the user.

Thus, in accordance with an important aspect of the present invention, the user may select from two different aerodynamic spin characteristics by simply gripping the present invention football in the opposite configuration shown in FIGS. 3 and 4 to produce opposite direction spin characteristics. As is further set forth below in FIGS. 3 and 4, the nonsymmetrical characteristic of ribs 20 through 25 further provides the user with a selection between two different gripping mechanisms. As is described below in greater detail when football 10 is gripped in the manner shown in FIG. 3, the user's fingers may contact and grip the relatively sharply inclined spaces of the underlying one of ribs 20 through 25. Conversely, when football 10 is gripped in the manner shown in FIG. 4, the user's fingers rest upon the less sharply angled curved surface of the underlying ones of ribs 20 through 25.

Thus, the present invention football provides for alternative aerodynamic characteristics and alternative gripping characteristics at the option of the user. This provides substantially increased variety and amusement for the user and presents an additional challenge in accurately throwing and handling the present invention football. For example, one spin direction and gripping configuration may be optimum for some users depending upon arm strength and hand size, for example, while other users may find the opposite gripping configuration and spin characteristic optimum. This presents substantial basis for experimentation and adds excitement to the use of the present invention football.

FIG. 2 sets forth a section view of football 10 taken along section lines 2—2 in FIG. 1. Thus, football 10 defines a resilient foam body 11 having a solid foam structure and defining a curved outer surface 12. A plurality of outwardly extending rib members 20 through 25 are formed in body 11 and are symmetrically spaced about outer surface 12. In accordance with an important aspect of the present invention, ribs 20 through 25 define nonsymmetrical aerodynamic and gripping characteristics referred to above. Specifically, rib 20 defines a curved surface 30 departing in a relatively gradual angle from outer surface 12 and extending from an edge 60 to an edge 50. An inclined face 40 extends at a relatively sharp angle to edge 50 to outer surface 12. Thus, curved face 30 and inclined face 40 define a generally "saw-tooth" cross-section. Ribs 21 through 25 are identical in cross-section to rib 20 and thus define respective curve surfaces 31 through 35 and inclined faces 41 through 45. Ribs 21 through 25 similarly define corresponding edges 61 through 65 respectively and edges 51 through 55 respectively.

In operation and with simultaneous reference to FIGS. 1 and 2, it will be apparent that as football 10 is rotated in the direction indicated by arrow 16, curved faces 30 through 35 of ribs 20 through 25 provide a gradually angled air foil-like surface as ribs 20 through 25 are moved through the surrounding air about outer surface 12. When rotated in the direction of arrow 16, inclined facets 40 through 45 of ribs 20 through 25 provide abrupt trailing edges to the airfoil shape presented by ribs 20 through 25. Conversely, when football 10 is rotated in the opposite direction indicated by arrow 17, the airfoil presented by ribs 20 through 25 defines a sharp leading edge formed by inclined faces 40 through 45 and a gently angled trailing edge formed by curved faces 30 through 35. Thus, the direction of spin alters the aerodynamic characteristic of football 10.

FIG. 3 sets forth a typical hand grip which may be used by a passer in passing football 10 to provide one aerodynamic or flight characteristic. Specifically, football 10 includes an oblate spheroidal body 11 preferably formed of a resilient foam material and defining an outer surface 12, end portions 13 and 14 and a major axis 15. As described above, football 10 further includes ribs 20 through 25 having cross-sectional shapes which define a generally saw-tooth characteristic. Rib 21 defines a gently angled curved face 31 and a sharply angled face 41. Faces 31 and 41 meet at an edge 51 while curved face 31 meets outer surface 12 at an edge 61. In the position shown in FIG. 3, a passer's hand 80 is gripping football 10 such that fingers 81 through 84 extend along the outer surface of body 11 on one side while thumb 85 extends along body 11 on the opposite side. Thus, in accordance with typical gripping action by a football passer, football 10 is received between fingers 81 through 84 and thumb 85 with hand 80 generally oriented along major axis 15. It will be apparent to those skilled in the art that the position of hand 80 along the outer surface of football 10 is adjusted by movement either closer to or farther from end portion 13 to compensate for the size and strength of the user's hand to acquire a comfortable, effective grip. In the configuration shown in FIG. 3, finger tips 86 through 89 of fingers 81 through 84 respectively are generally positioned along sharply inclined face 41 of rib 21 and also grip edge 51 thereof. Thumb 85 extends about the opposite side of football 10 and the position of hand 80 is adjusted to comfortable place thumb 85 in accordance with the user's preference.

Thus, with football 10 gripped in the manner shown in FIG. 3, the passing action of the user may be applied to launch football 10 and, in accordance with the natural action which occurs as the user's passes football 10 gripped in the manner shown in FIG. 3, the football is rotated about major axis 15 in the direction of arrow 16. As is described above, the passing of football 10 when gripped in the manner shown in FIG. 3 causing a spin in the direction of arrow 16 presents an aerodynamic characteristic in which the leading edge of ribs 20 through 25 are formed by gently curved faces 30 through 35 and abruptly or sharply angled faces 40 through 45.

FIG. 4 sets forth football 10 gripped by a user's hand generally referenced by numeral 80 in which football 10 is oppositely oriented from the position shown in FIG. 3. Thus, finger tips 86 through 89 of hand 80 are positioned generally along curved face 31 of rib 21. When so positioned, face 41 is not in contact with fingers 81 through 84 and edge 51 of rib 21 is positioned differently with respect to finger tips 86 through 89 to produce a different gripping feel and characteristic from that shown in the configuration of FIG. 3. Thus, the user again adjusts the position of hand 80 to provide a comfortable and effective gripping action in which fingers 81 through 84 extend along one side of football 10 while thumb 85 extends along the other side. While the position of hand 80 may be adjusted to user comfort, it is generally anticipated that finger tips 86 through 89 will be positioned along curved face 31 of rib 21 in the manner shown in FIG. 4.

In operation, when football 10 is gripped in the alternative arrangement shown in FIG. 4 and thrown in accordance with a conventional passing action, football 10 is rotated about major axis 15 in the opposite direction to that shown in FIG. 3 which is referenced by arrow 17. The rotation about major axis 15 in the direction of arrow 17 causes the aerodynamic configuration of ribs 20 through 25 to present a sharply inclined bleeding edge formed by faces 40 through 45 and a gently angled trailing edge formed by faces 30 through 35.

Thus, comparison of FIGS. 3 and 4 shows that the present invention football may be gripped in either of two alternative gripping patterns to provide decidedly distinct gripping characteristics and feel. Furthermore, when football 10 is thrown, the major axis spin or spiral which results from the natural passing action carried forward by the user presents a different and distinct aerodynamic characteristic depending upon the gripping configuration selected. Thus, the user may experiment with a variety of gripping placements of the user's hand upon the present invention football and may further experiment with the correspondingly distinct aerodynamic characteristic produced by opposite directions of spin as the football is thrown.

It will be apparent to those skilled in the art that the embodiment shown in FIGS. 1 through 4 may be varied substantially without departing from the spirit and scope of the present invention. For example, while the embodiment shown is formed of a solid foam resilient body, it may alternatively be formed of a resilient material having a center cavity or pressurized air body therein. Similarly, it may be desirable in some game activities to form football 10 of a less resilient material such as molded plastic using manufacturing techniques such as conventional blow molding. In addition, it will be apparent that while the embodiment shown defines five outer ribs, a different number of ribs may be utilized without departing from the spirit and scope of the present invention.

What has been shown is a new and improved football having alternative gripping feel and configuration available to the user as well as alternative aerodynamic characteristics depending upon the grip used and the direction of spin. The football thus provided enhances the play value and interest as well as the skill requirement of the user to improve its desirability and amusement and entertainment function.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A football for use by a passer applying a hand grip thereto, said football comprising:

an oblate spheroidal body having a football shape and defining a convex outer surface and generally pointed ends and a major axis; and a plurality of spaced-apart rib members extending outwardly from said outer surface forming spiral curves about said major axis, said rib members defining generally peaked portions above said convex surface and unequal surfaces extending from said peaked portions to said convex surface to form nonsymmetrical cross-sections to produce different aerodynamic effects in each spin direction about said major axis and different grip characteristics when held in a passer's hand from alternative sides.

2. A football as set forth in claim 1 wherein said unequal surfaces define first and second surfaces and wherein said peaked portions are formed of an edge at the intersections thereof and wherein said first surfaces are substantially greater in area than said second surfaces.

3. A football as set forth in claim 2 wherein said first and second surfaces form a generally saw-tooth cross-section.

4. A football as set forth in claim 3 wherein said first surfaces of said rib members form substantially smaller angles with said outer surface and said second surfaces form substantially greater angles with said outer surface.

5. A football as set forth in claim 4 wherein said first surfaces are convexly curved.

6. A football as set forth in claim 5 wherein said body is formed of a resilient foam material.

7. A football as set forth in claim 6 wherein said rib members define cross-sections which are minimum near said ends of said body and taper toward a maximum near the middle of said body.

8. A football as set forth in claim 7 wherein said rib members terminate at equal distances from said ends of said body.

9. A football as set forth in claim 8 wherein said rib members are helically curved.

10. A football as set forth in claim 1 wherein said spiral curves form helixes.

11. A football comprising:

a body defining an oblate spheroid having a constant radius convex outer surface, pointed ends and a major axis extending therethrough; and a plurality of helical rib members extending outwardly from said outer surface and defining nonsymmetrical cross-sections including first and second unequal area oppositely angled gripping surfaces forming a gripping ridge therebetween.

12. A football as set forth in claim 11 wherein said rib members extending from said outer surface provide different aerodynamic characteristics as a function of the direction of spin applied by a passer about said major axis.

* * * * *